US011066853B2

(12) United States Patent
Ney et al.

(10) Patent No.: US 11,066,853 B2
(45) Date of Patent: Jul. 20, 2021

(54) ELECTRIC DOOR LOCK MECHANISM AND METHOD TO OVERRIDE

(71) Applicant: Inteva Products, LLC, Troy, MI (US)

(72) Inventors: Daniel Alexander Ney, Lake Orion, MI (US); Donald Michael Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 535 days.

(21) Appl. No.: 15/862,325

(22) Filed: Jan. 4, 2018

(65) Prior Publication Data

US 2019/0203507 A1 Jul. 4, 2019

(51) Int. Cl.
*E05B 81/16* (2014.01)
*E05B 81/04* (2014.01)
(Continued)

(52) U.S. Cl.
CPC ..... *E05B 81/16* (2013.01); *E05B 13/005* (2013.01); *E05B 77/54* (2013.01); *E05B 79/20* (2013.01);
(Continued)

(58) Field of Classification Search
CPC ..... E05B 81/16; E05B 81/04; E05B 81/46; E05B 81/90; E05B 81/06; E05B 81/14; E05B 81/48; E05B 77/54; E05B 79/20; E05B 79/22; E05B 83/36; E05B 13/00; Y10T 292/1057; Y10T 292/1082; Y10T 74/2045; Y10T 74/20462; Y10S 292/22; Y10S 292/23; Y10S 292/65; G05G 5/00; G05G 5/28; F16C 1/12; F16C 1/14; F16C 1/145; F16C 1/16; F16C 1/18; F16C 1/101; F16C 1/102; F16C 1/105; F16C 1/262
(Continued)

(56) References Cited

U.S. PATENT DOCUMENTS 4,998,447 A * 3/1991 Feichtiger ..... E05B 13/005 292/201
5,182,963 A 2/1993 Perisho et al.
(Continued)

FOREIGN PATENT DOCUMENTS

CN 1253606 A 5/2000
CN 101824941 A 9/2010
(Continued)

OTHER PUBLICATIONS

Computer Generated Translation for DE 202016104529, Generated on Apr. 24, 2020, https://worldwide.espacenet.com/ (Year: 2020).*
(Continued)

*Primary Examiner* — Alyson M Merlino
(74) *Attorney, Agent, or Firm* — Cantor Colburn LLP

(57) ABSTRACT

A lock mechanism for a vehicle latch includes a cable link. Also included is a pawl release link, the cable link and the pawl release link switchable between an engaged condition and a disengaged condition, the engaged condition allowed manual release of the vehicle latch, the disengaged condition preventing release of the vehicle latch. Further included is an electrically driven gear operatively coupled to the cable link and the pawl release link to reset the cable link and the pawl release link to the disengaged condition.

17 Claims, 13 Drawing Sheets

(51) Int. Cl.

| | |
|---|---|
| ***E05B 79/20*** | (2014.01) |
| ***E05B 77/54*** | (2014.01) |
| ***E05B 81/46*** | (2014.01) |
| ***E05B 13/00*** | (2006.01) |
| ***E05B 81/06*** | (2014.01) |
| ***E05B 81/90*** | (2014.01) |
| ***E05B 83/36*** | (2014.01) |
| *E05B 81/14* | (2014.01) |

(52) U.S. Cl.
CPC ..... *E05B 81/04* (2013.01); *E05B 81/46* (2013.01); *E05B 81/90* (2013.01); *E05B 83/36* (2013.01); *E05B 81/06* (2013.01); *E05B 81/14* (2013.01)

(58) Field of Classification Search
USPC ..... 74/502.6; 403/330
See application file for complete search history.

(56) References Cited

U.S. PATENT DOCUMENTS

| | | | | |
|---|---|---|---|---|
| 2003/0080569 | A1* | 5/2003 | Raymond | E05B 81/20 292/201 |
| 2015/0052958 | A1 | 2/2015 | Perocak et al. | |
| 2016/0258193 | A1* | 9/2016 | Rosales | E05B 77/12 |
| 2016/0258194 | A1* | 9/2016 | Rosales | E05B 77/12 |
| 2017/0321456 | A1* | 11/2017 | Jeong, Il | E05B 79/20 |
| 2018/0179790 | A1* | 6/2018 | Jeong, Il | E05B 81/14 |
| 2018/0355640 | A1* | 12/2018 | Jeong, Il | E05B 79/20 |

FOREIGN PATENT DOCUMENTS

| | | | | |
|---|---|---|---|---|
| CN | 106567925 | A | 4/2017 | |
| DE | 202016100521 | U1 | 2/2016 | |
| DE | 202016103804 | U1 | 10/2017 | |
| DE | 202016104529 | U1 | 11/2017 | |
| EP | 1094180 | A2 * | 4/2001 | E05B 81/16 |
| WO | WO-9531763 | A1 * | 11/1995 | E05B 13/005 |

OTHER PUBLICATIONS

Computer Generated Translation for WO 95/31763, Generated on Feb. 25, 2021, https://worldwide.espacenet.com/ (Year: 2021).*
English Machine Translation to Abstract DE202016100521.
English Machine Translation to Abstract DE202016103804.
English Machine Translation to Abstract DE202016104529.
European Search Report for Application No. EP 18 20 7742.
Written Opinion for Application No. EP 18 20 7742.
CN First Office Action for Application No. 2018112819869; dated Apr. 27, 2021.
CN Search Report for Application No. 2018112819869; dated Apr. 20, 2021.
English Translation to CN First Office Action for Application No. 2018112819869; dated Apr. 27, 2021.

* cited by examiner

ELECTRIC DOOR LOCK MECHANISM AND METHOD TO OVERRIDE

BACKGROUND

The subject matter disclosed herein relates to latch assemblies and, more particularly, to a door lock mechanism for a vehicle latch, as well as a method for overriding the door lock mechanism.

Some vehicle latch assemblies include a power release system that is returned (i.e., reset) after power release activation. Some regulations regarding automotive side doors that are hinged on a rear side of the door, relative to the vehicle, are required not to open above a certain speed of the vehicle. By way of example, some regulations may impose this requirement at speeds at or above 4 KPH (approx. 2.5 MPH). This entails disengaging any release mechanism from the inside of the vehicle when the vehicle is moving. Currently, the only method of complying with such a requirement is to provide some form of electrical device to disengage the release geometry to/in the door latch to prevent the release function. In doing so, the lock device will need to cycle every time the vehicle operates below and above the threshold speed (e.g., 4 KPH), thus raising durability concerns with the components of the lock device.

SUMMARY

According to one aspect of the disclosure, a lock mechanism for a vehicle latch is provided. The lock mechanism includes a release cable actuated by a handle available to a user. Also included is a cable end fitting disposed at an end of the release cable. Further included is a cable link defining an opening for receiving the release cable, the cable link retaining the cable end fitting therein, wherein tensioning of the release cable translates the cable link from a first position to a second position by overcoming a spring force applied to the cable link, the spring force biasing the cable link to the first position. Yet further included is a pawl release link selectively coupled to the cable link, the pawl release link and the cable link switchable between a coupled condition and a decoupled condition, the coupled condition resulting in corresponding translation of the cable link and the pawl release link, the decoupled condition resulting in independent translation of the cable link and the pawl release link. Also included is a release clutch pivotably coupled to the cable link and moveable between an unlocked positon position and a locked position, the unlocked position disposing the release clutch in contact with the pawl release link to couple the cable link and the pawl release link, the locked position decoupling the cable link and the pawl release link. Further included is an electrically driven gear operative with the release clutch to electrically reset the release clutch to the locked position upon detection of a vehicle speed in excess of a threshold speed.

According to another aspect of the disclosure, a lock mechanism for a vehicle latch includes a cable link. Also included is a pawl release link, the cable link and the pawl release link switchable between an engaged condition and a disengaged condition, the engaged condition allowed manual release of the vehicle latch, the disengaged condition preventing release of the vehicle latch. Further included is an electrically driven gear operatively coupled to the cable link and the pawl release link to reset the cable link and the pawl release link to the disengaged condition.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawing in which:

Figure 1:
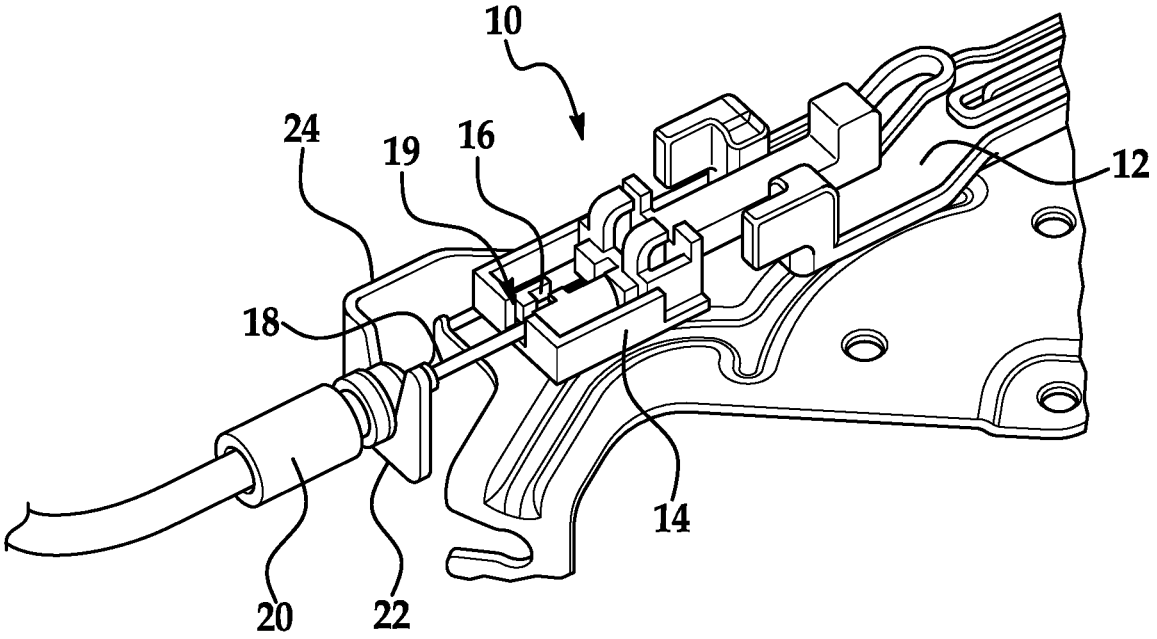
FIGS. 1-10 illustrate a door lock mechanism with a cable link and a pawl release link in various positions.

The detailed description explains embodiments of the invention, together with advantages and features, by way of example with reference to the drawing.

DETAILED DESCRIPTION OF THE INVENTION

Referring to the Figures, a door lock mechanism for a vehicle door is illustrated. The door lock mechanism may be employed with numerous types of vehicle doors and vehicle latch assemblies. In some embodiments, the door lock mechanism is utilized with a vehicle door that is hinged on the rear side of the door, relative to the length of the vehicle. As described herein, the disclosed embodiments effectively decoupled a door latch release mechanism and provides a mechanical way to override the mechanism in the event of a power loss by double-pulling on the manual release handle. Under a normal operating condition, the lock mechanism will reset electrically after the first pull of the release handle, thus not allowing for a release event on the second pull of the handle. Normal operating condition refers to vehicle power being present and available and may also be referred to herein as a first operating condition. In the event of a disruption or loss of vehicle power (also referred to herein as a second operating condition), the electrical reset will not occur and the latch will be allowed to release manually upon the second actuation of the door handle.

Throughout the Figures, the door lock mechanism is generally referenced with numeral 10. Components are progressively discussed, with certain features omitted from some Figures to more clearly illustrate the structural and functional details of each component.

Referring to FIG. 1, a portion of the door lock mechanism 10 is illustrated. In particular, a pawl release link 12, a cable link 14, a cable end fitting 16, and a release cable 18 are shown. The pawl release link 12 and the cable link 14 slide linearly with each other and on the same plane, and in the same direction as the axis of the cable end fitting 16. The cable end fitting 16 is retained within the cable link 14. In particular, the cable end fitting 16 is positioned within the cable link 14 by extending through a slot or opening 19 defined by the cable link 14. The cable end fitting 16 may be any suitable shape that is sized to prevent withdrawal from the cable link 14 during tensioning of the release cable 18. The cable end fitting 16 drives the cable link 14 and, when coupled with the pawl release link 12, will release the system. The cable link 14 returns itself and the cable end fitting 16 to their initial position using a return spring. A cable conduit 20 is press fit into a tab 22 extending from a backplate 24. The cable conduit 20 remains static in this position through all positions and functions of the mechanism 10 described herein.

Figure 2:
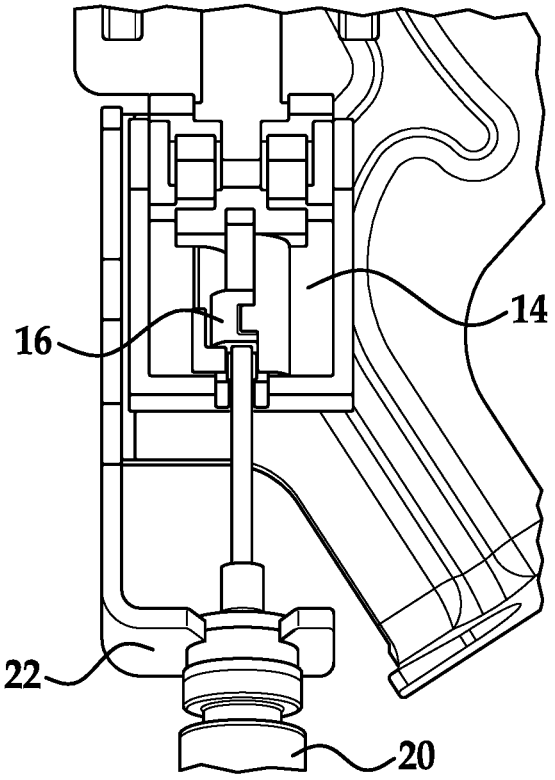
Figure 3:
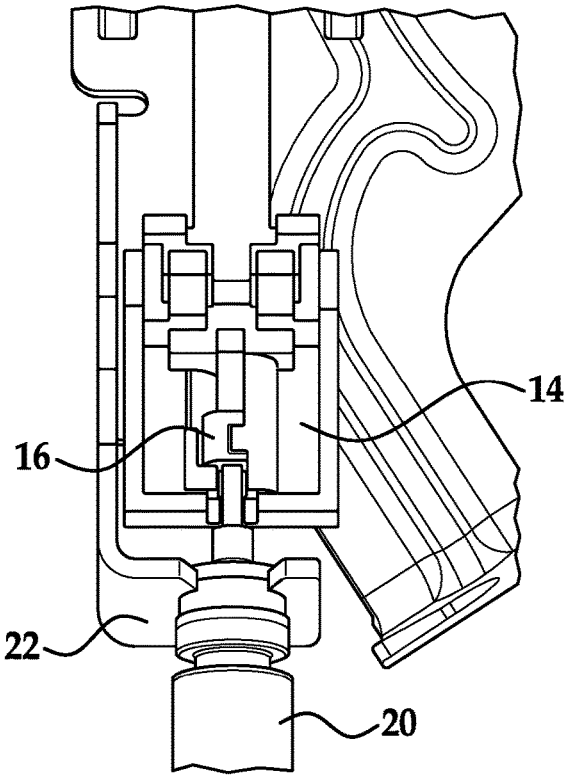
Figure 4:
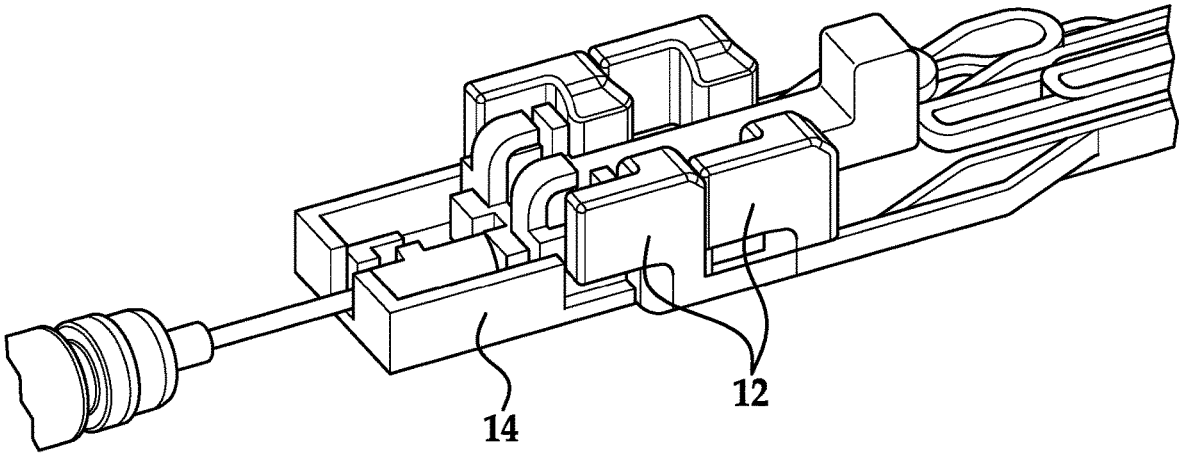
Figure 5:
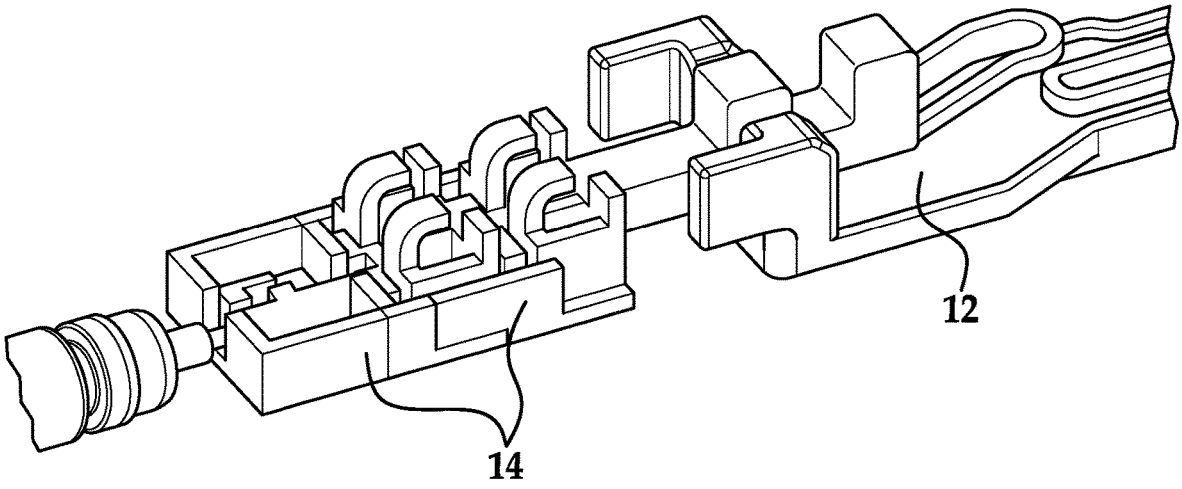

As shown in FIGS. 2 and 3, the cable link 14 is moveable between a first position (FIG. 2) and a second position (FIG. 3). The first position refers to a home position of the cable link 14 that is present in an initial state of the cable link 14. The second position refers to a released position and is shown at its full travel position away from the first position. The pawl release link 12 and the cable link 14 can move independently of each other. FIG. 4 shows the pawl release link 12 in an initial and final position and FIG. 5 shows the cable link 14 in an initial and final position (i.e., first and second position) of the cable link.

Figure 6:
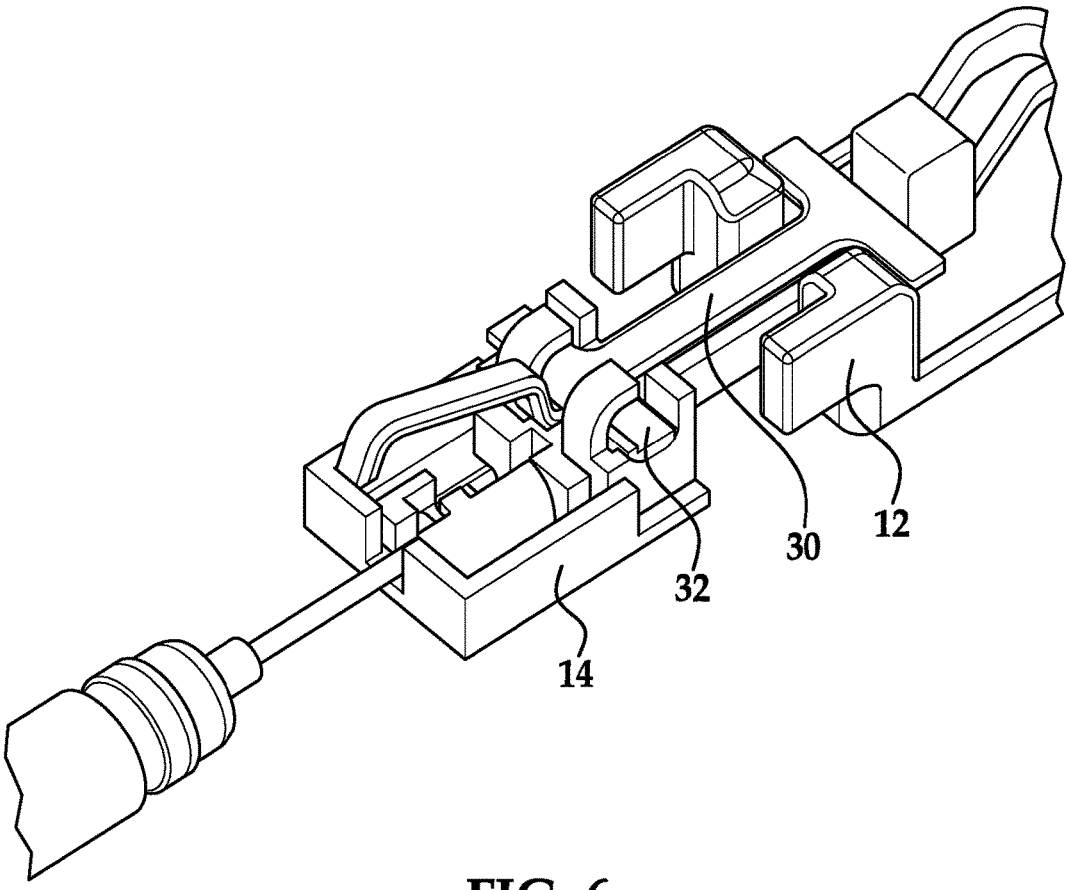
Figure 7:
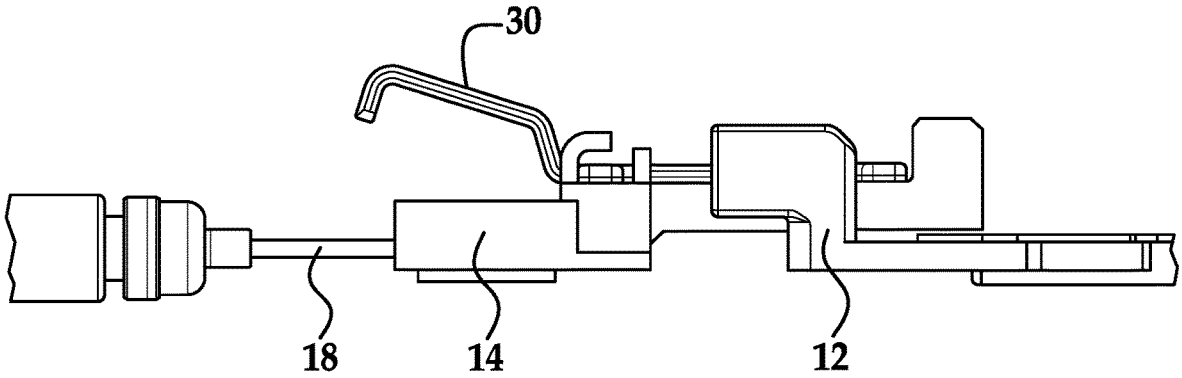
Figure 8:
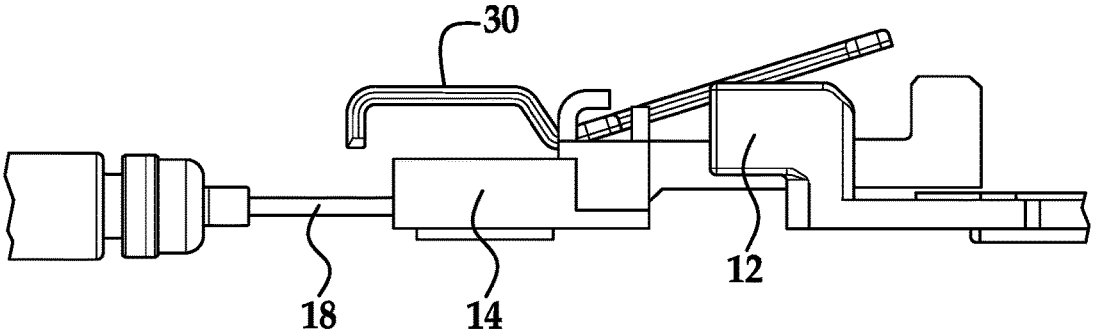
Figure 9:
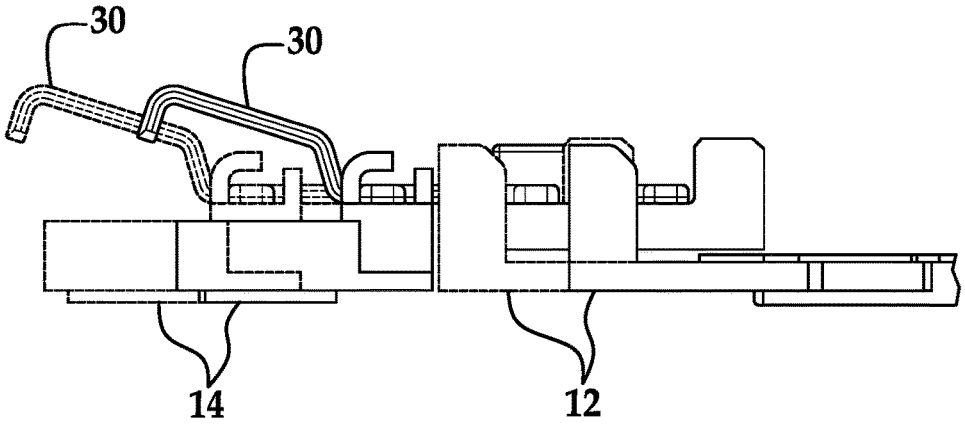
Figure 10:
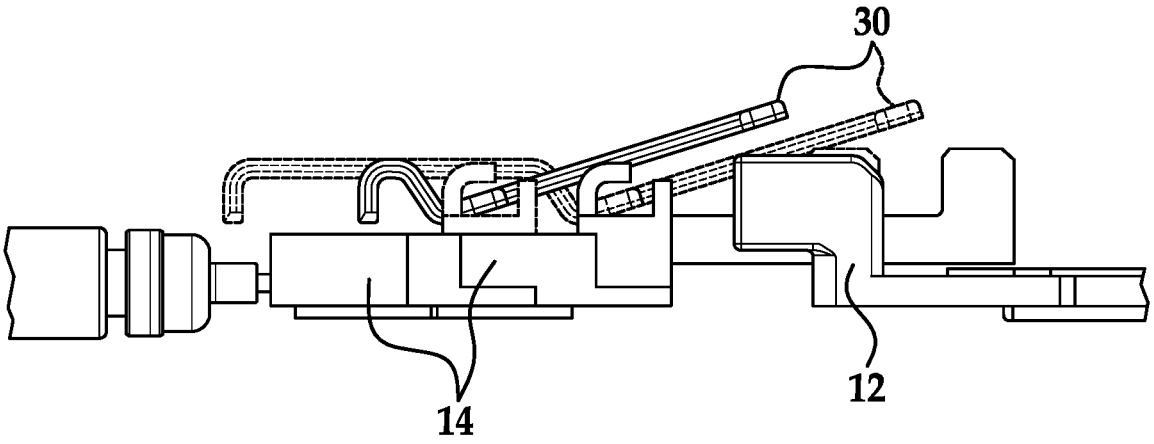

FIG. 6 illustrates a release clutch 30 operatively coupled to the cable link 14. In particular, a portion of the release clutch 30 is disposed within a slot 32 of the cable link 14 and retained therein. The release clutch 30 is pivotable about the portion of the release clutch 30 disposed within the slot 32. The release clutch 30 is coupled between the cable link 14 and the pawl release link 12, and becomes loaded in shear when the cable link 14 is actuated. The release clutch 30 is selectively engaged with the pawl release link 12 due to the pivotable nature of the release clutch 30. Specifically, the release clutch 30 is pivotably between an unlocked position (FIG. 7) and a locked position (FIG. 8). As shown, the unlocked position is defined by a coupled relationship of the cable link 14 and the pawl release link 12 when the release clutch 30 is pivoted to be in engagement with the pawl release link 12. In this orientation, the release cable 18 is able to pull on the cable link 14 and drive the pawl release link 12 to release the latch, as shown by the two positions illustrated in FIG. 9. The locked position is defined by a decoupled relationship of the cable link 14 and the pawl release link 12 when the release clutch 30 is pivoted to be out of engagement with the pawl release link 12. In this orientation, the release cable 18 pulls on the cable link 14, without actuating the pawl release link 12, thereby not releasing the latch, as shown by the two positions illustrated in FIG. 10.

Figure 11:
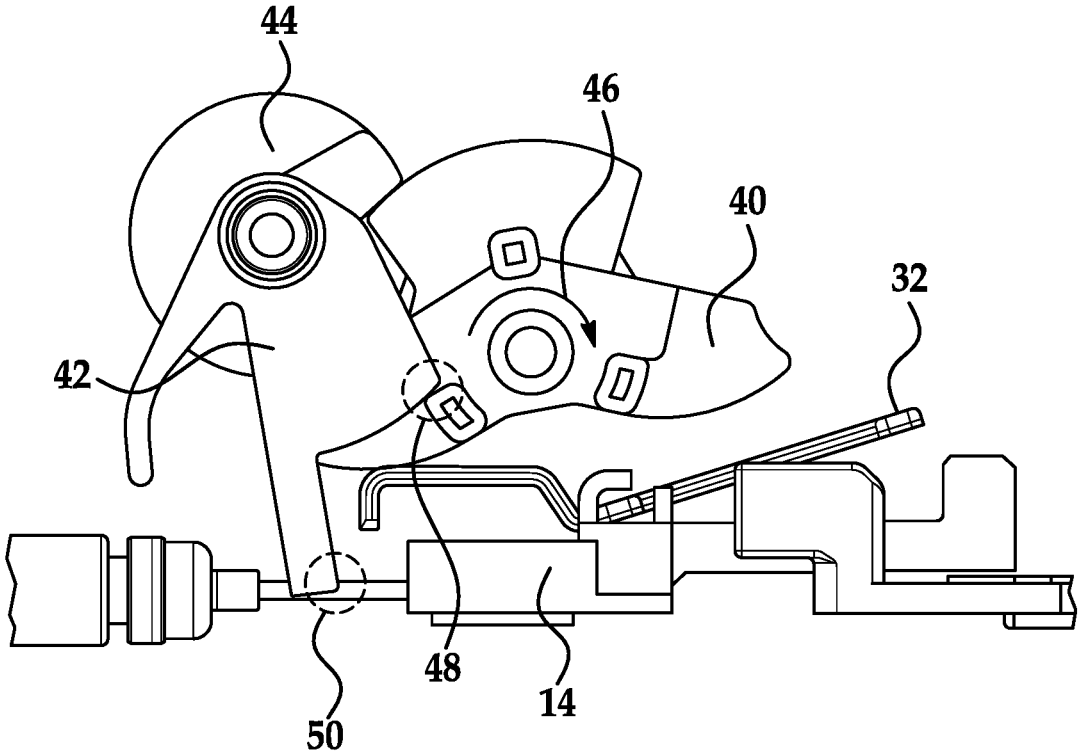
FIGS. 11-26 illustrate a cam, a pawl and an electrically driven gear of the door lock mechanism in various positions.

Referring now to FIG. 11, a cam 40, a pawl 42 and a gear 44 are illustrated. The cam 40 is used to control the state of the release clutch 30. The cam is naturally returned in the clockwise direction (in the illustrated perspective) with a return spring 46. The pawl 42 holds the cam 40 in a "locked" state by interfacing with a catch feature 48 until the cable link 14 is actuated and disengages the pawl 42 from the cam 40 by contacting a pawl override contact surface 50, thereby allowing the cam 40 to return to an "unlocked" state via the cam return spring 46. The pawl 42 naturally is returned in a counterclockwise direction (in the illustrated perspective). The gear 44 rotates clockwise (in the illustrated perspective) and drives the cam 40 to a "locked" state, and then continues its rotation until it hard stops on the cam 40.

Figure 12:
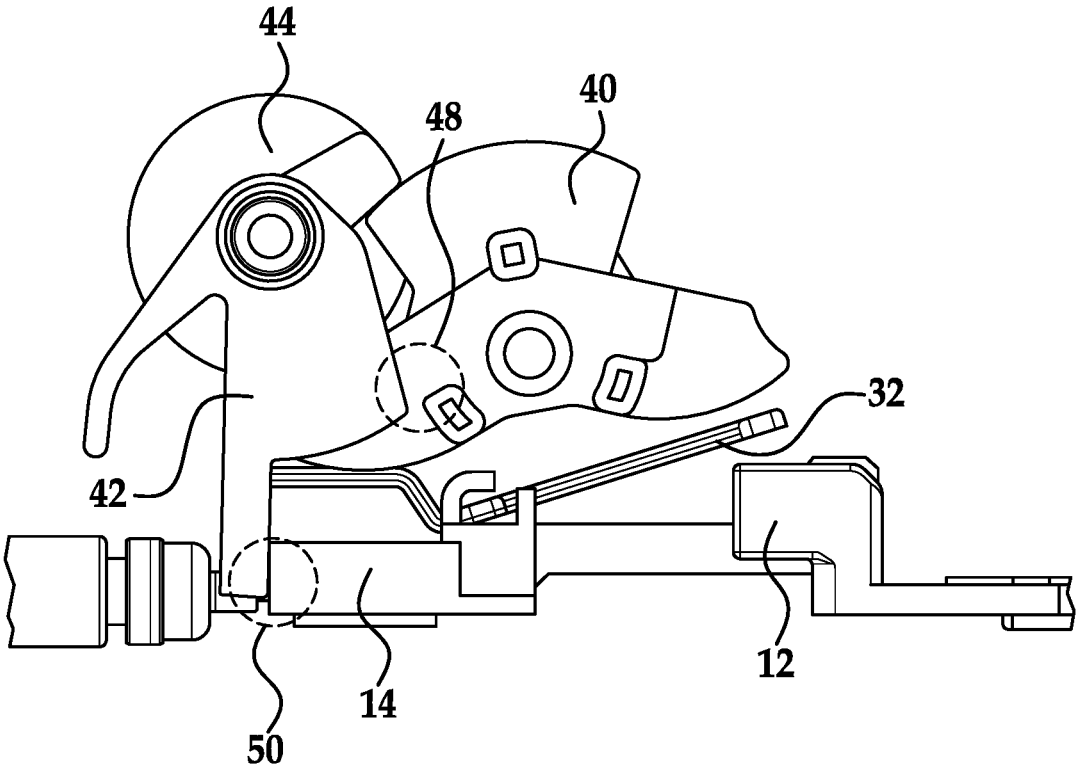
Figure 13:
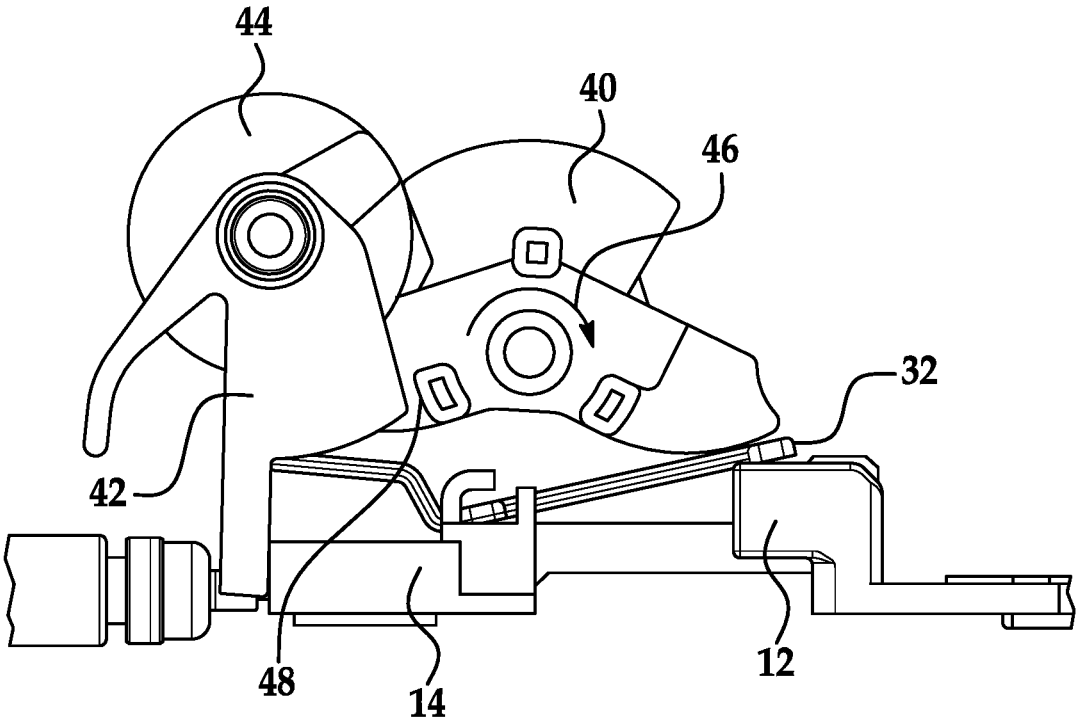
Figure 14:
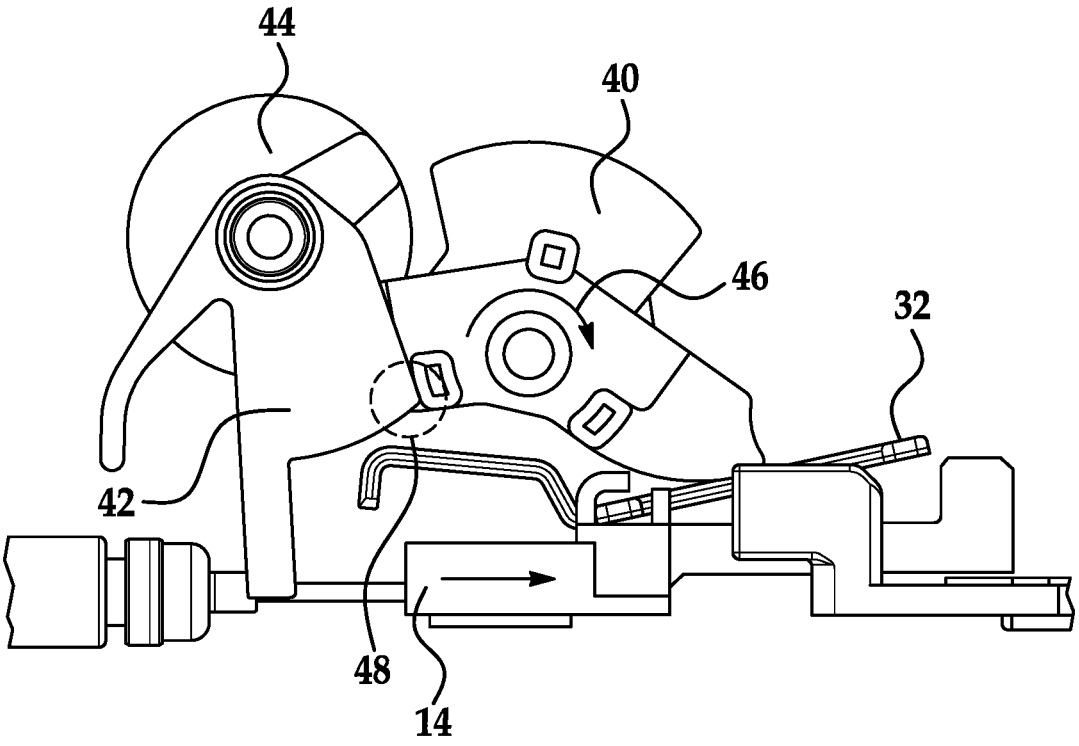
Figure 15:
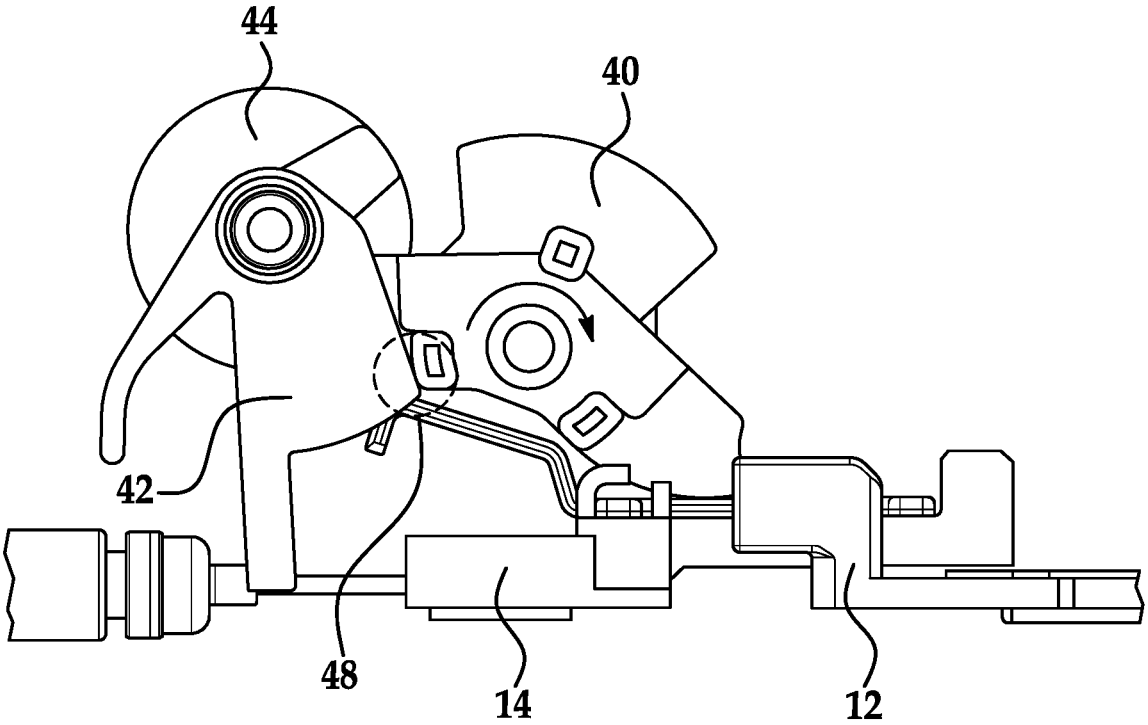
Figure 16:
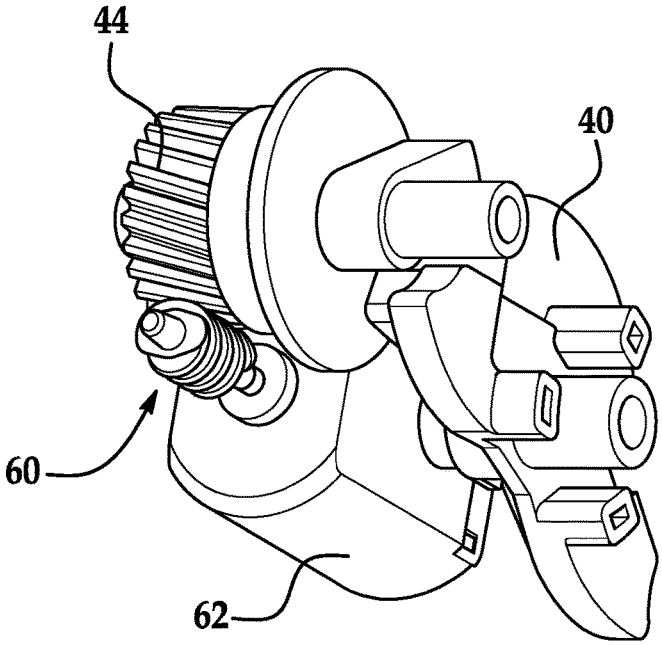

FIGS. 12-26 illustrate the drive door lock mechanism 10 in a plurality of positions, conditions and states. FIG. 12 illustrates the position of the pawl 42 when it is moved to a release position by the cable link 14 to achieve full travel. The pawl 42 becomes disengaged from the cam catch feature 48 in this position. FIG. 13 shows the cam 40 returning via return spring 46 and driving the release clutch 30 to ride on the pawl release link 12. FIG. 14 displays the cable link 14 returning to its home position. The pawl 42 is now riding on the cam catch feature 48 and the cam 40 is driving the release clutch 30 counterclockwise, and is now free to couple the release clutch 30 between the cable link 14 and the pawl release link 12. FIG. 15 shows the system back in an "unlocked" state. The cam 40 is driving the release clutch 30 and coupling it between the cable link 14 and the pawl release link 12. The pawl 42 is resting on the cam 40 and the latch is now able to be manually released.

Figure 17:
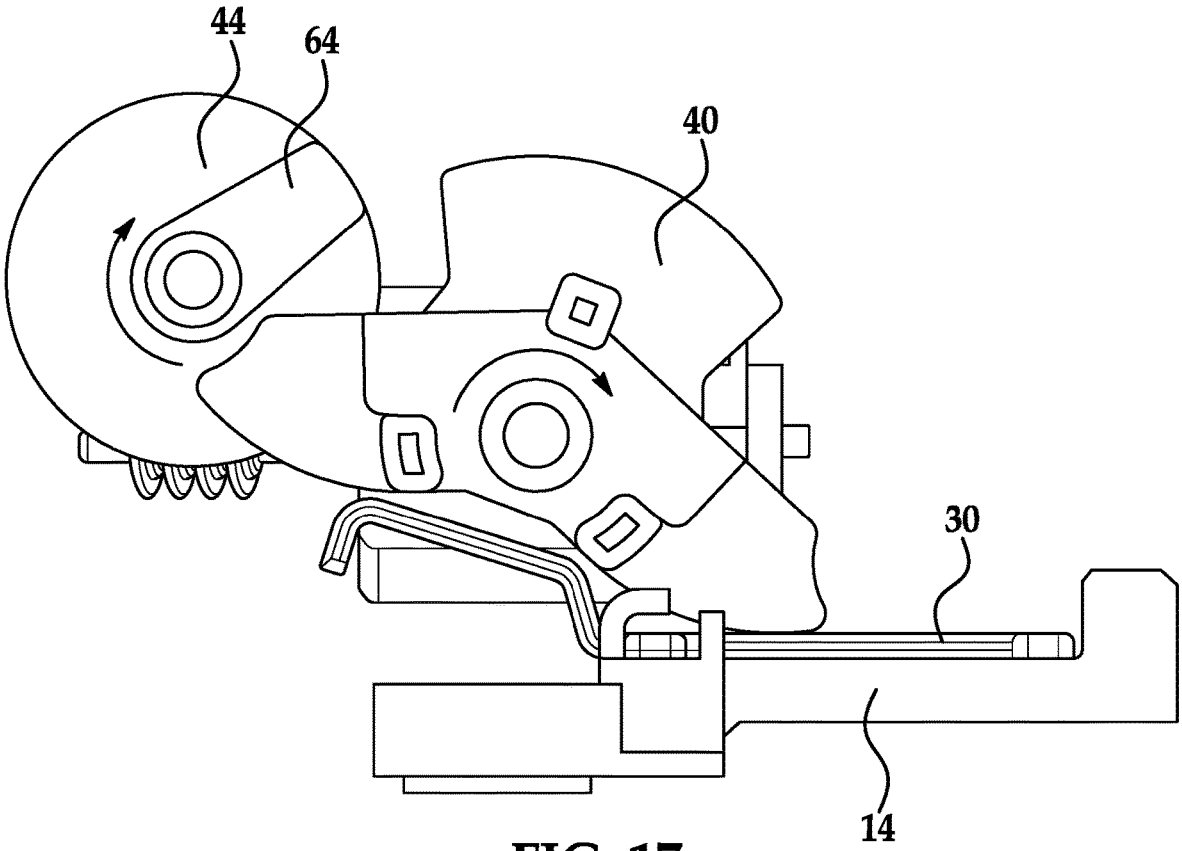
Figure 18:
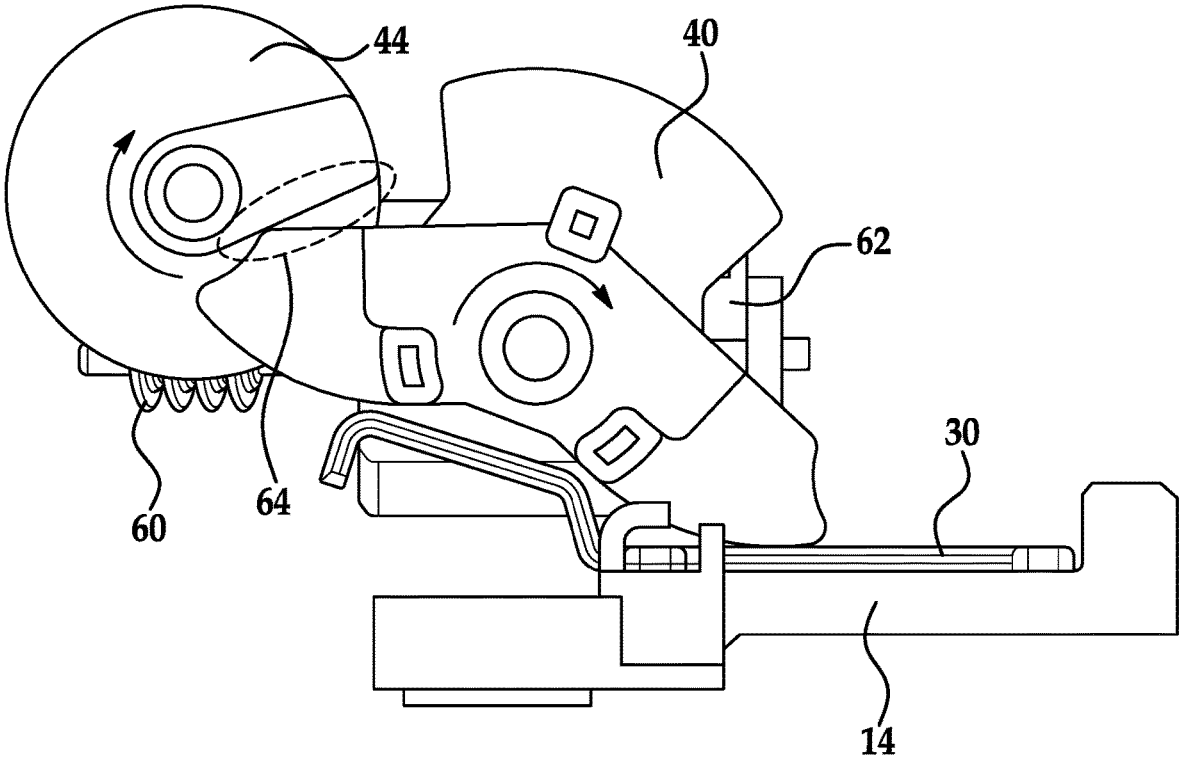
Figure 19:
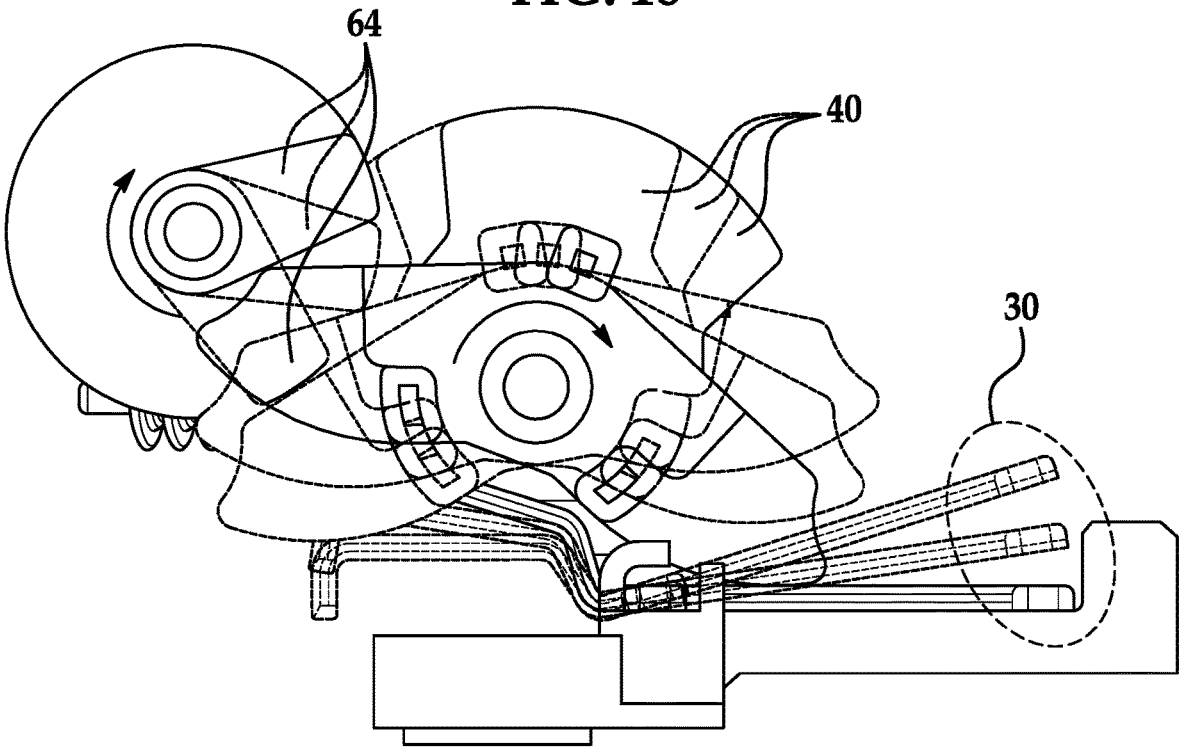
Figure 20:
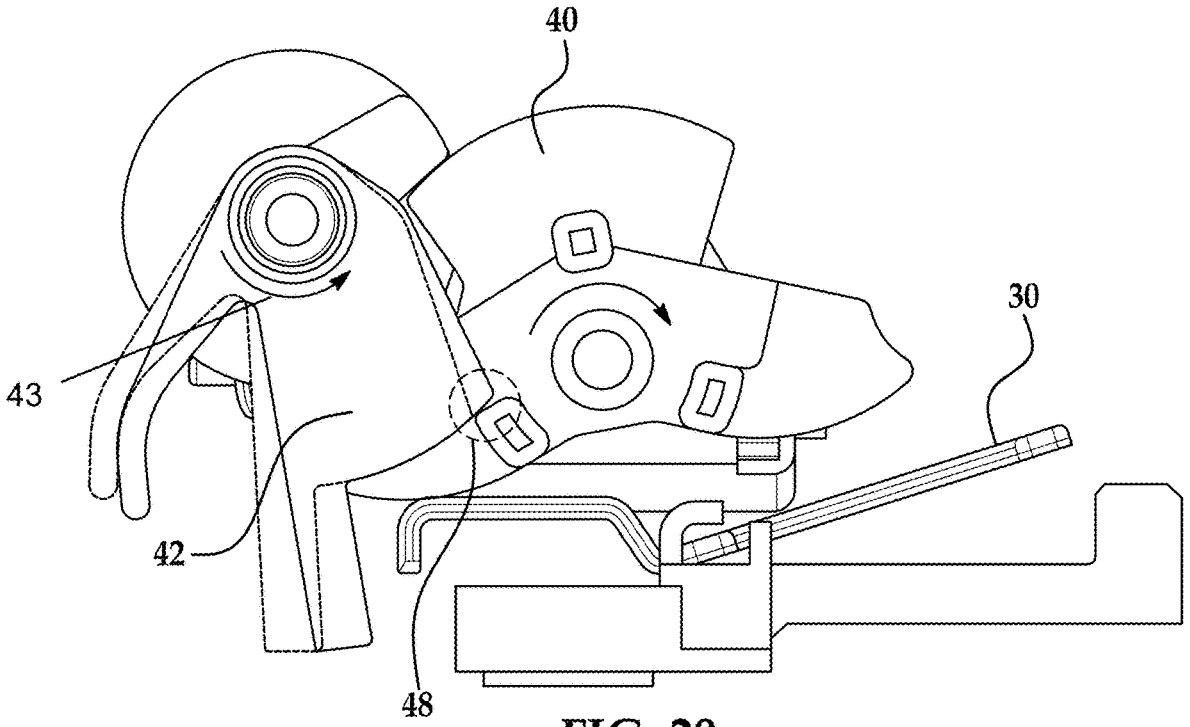
Figure 21:
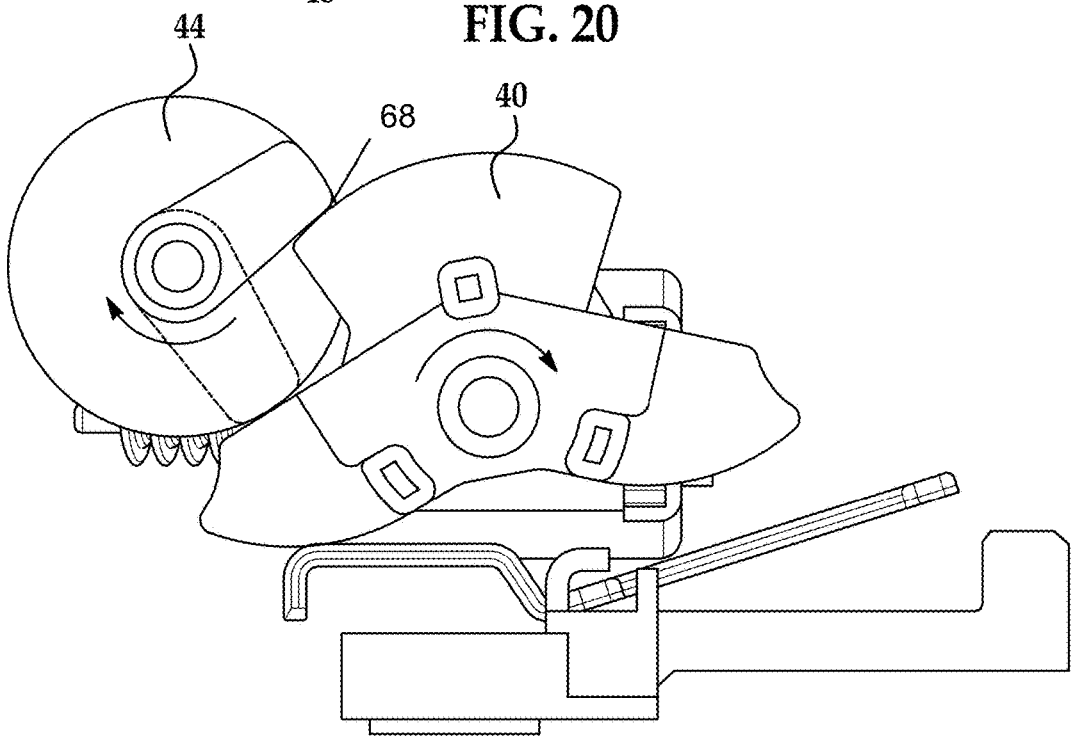
Figure 22:
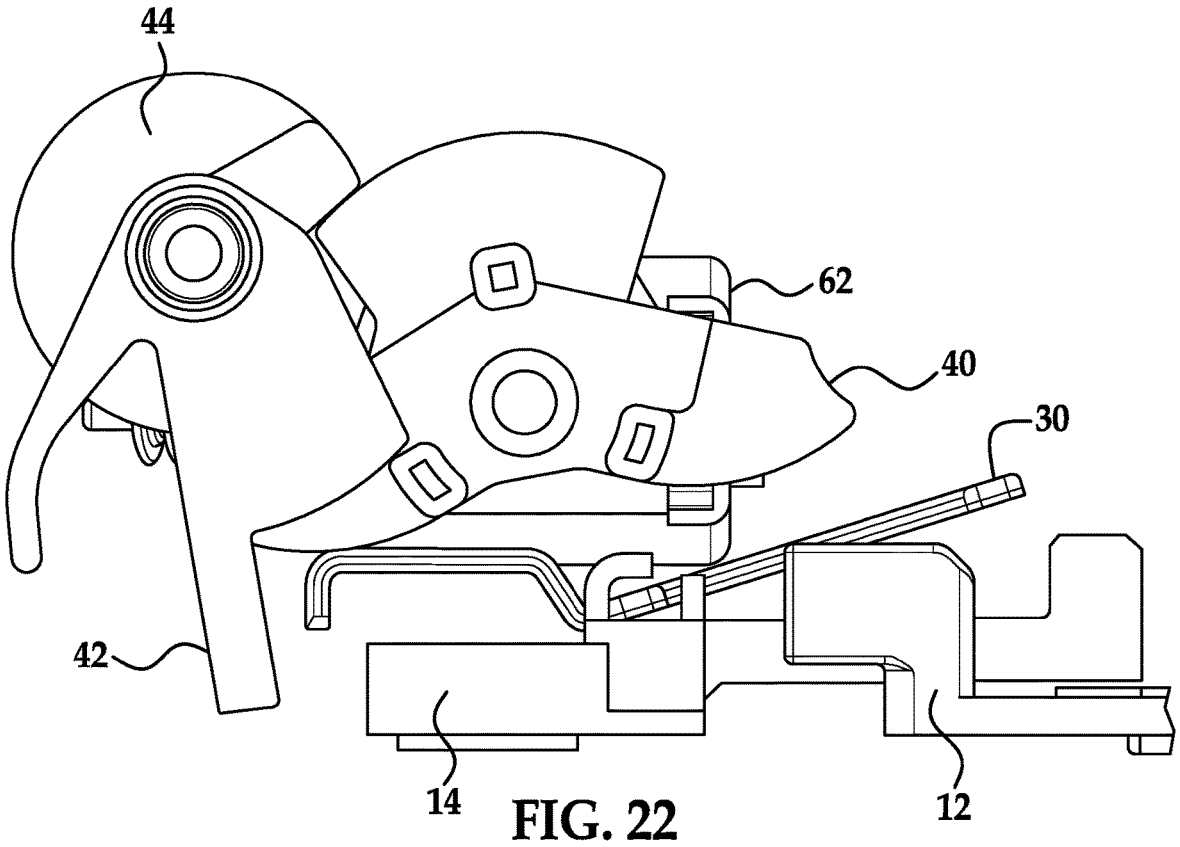

FIGS. 16-22 illustrate the cam 40, the gear 44, a worm gear 60 and a motor 62. These components provide electric relocking functionality. FIG. 17 shows the system in an "unlocked" state. The cam 40 is naturally being returned and a gear cam drive feature 64 is free to rotate clockwise. FIG. 18 shows the gear 44 rotating clockwise (in the illustrated perspective). It is being driven by the motor 62 and the worm gear 60. The gear 44 is making it initial contact with the cam 40 via the gear cam drive feature 64, and is beginning to drive it clockwise. FIG. 19 illustrates the travel of the gear 44, the cam 40 and the release clutch 30, as the gear 44 drives the cam 40 from an "unlocked" state to a "locked" state. FIG. 20 shows the action of the pawl 42 as the cam 40 moves to a "locked" state. In one non-limiting embodiment, the pawl is spring biased in a first rotatable direction by a spring 43. The pawl 42 moves into a bite condition with the cam catch feature 48 and holds the system in a "locked" state. FIG. 21 shows the remaining travel of the gear 44 after it has driven the cam 40 to a "locked" state. The gear 44 continues its clockwise rotation until it hard stops on a cam stop surface 68. FIG. 22 shows the system in a "locked" state after an electric relock.

Figure 23:
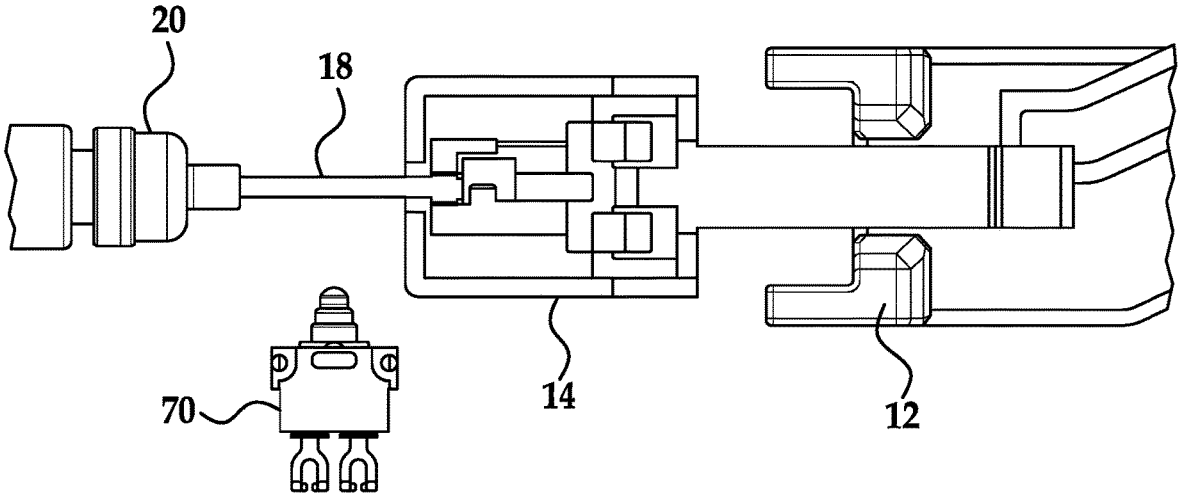
Figure 24:
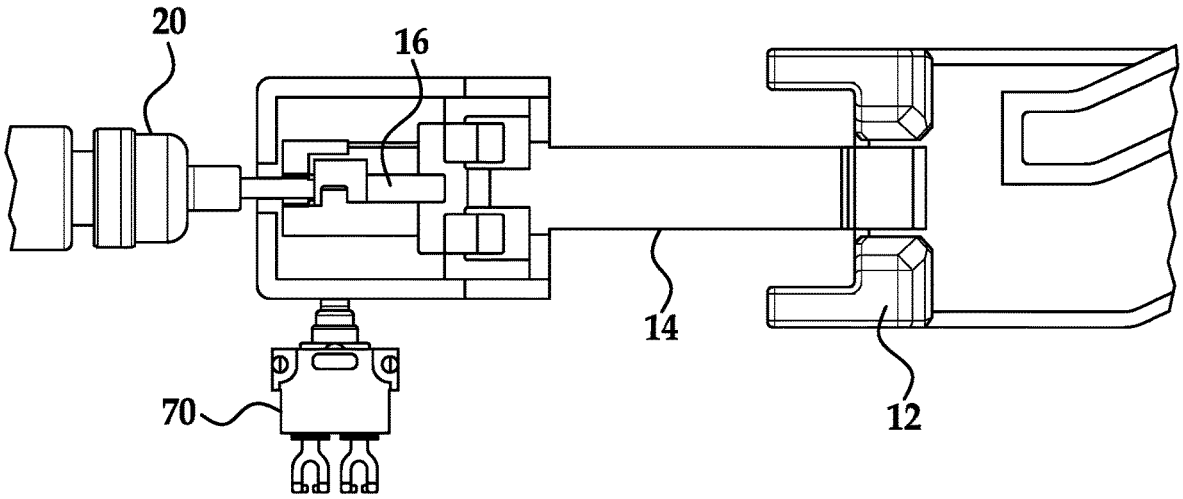
Figure 25:
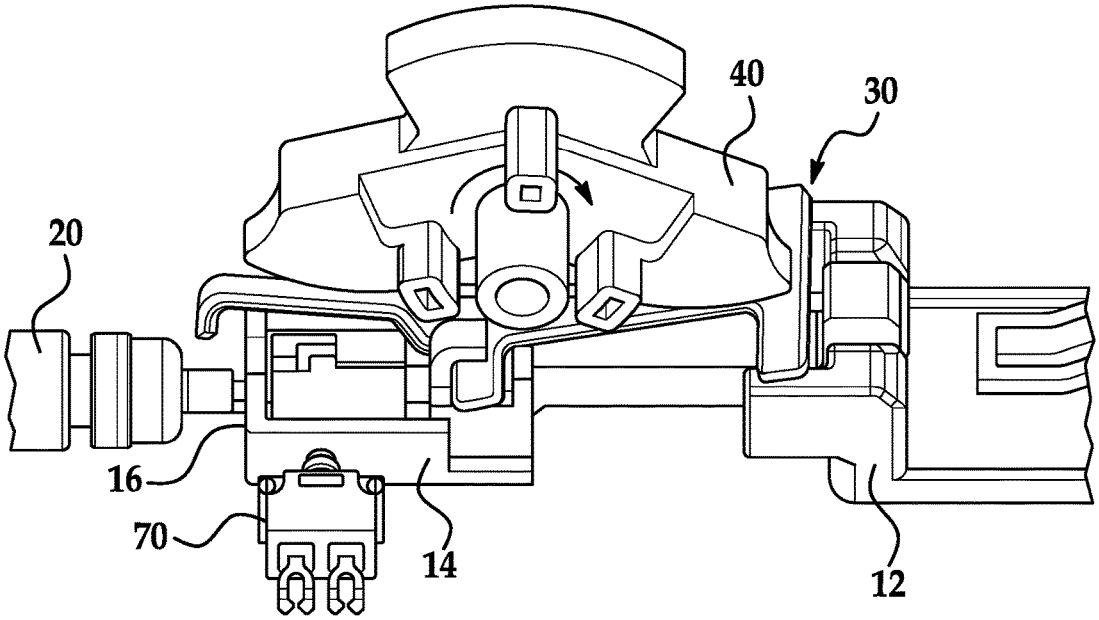
Figure 26:
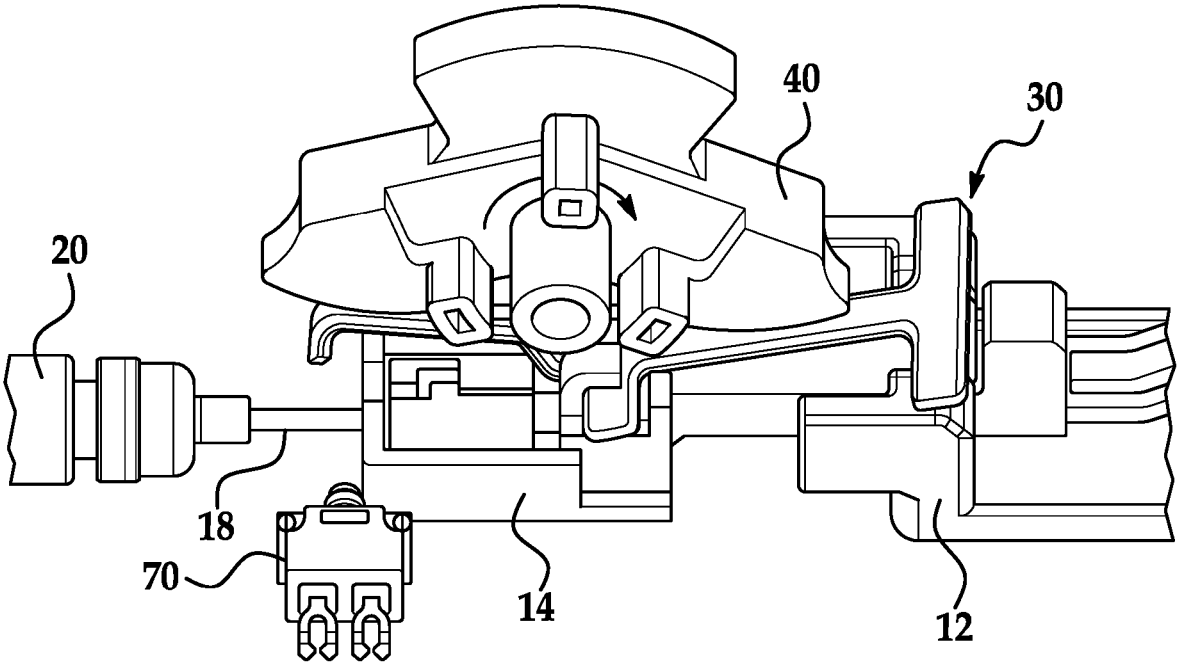

Referring now to FIGS. 23-26, a switch 70 is illustrated at various positions. FIG. 23 shows switch 70 displayed position when the cable link 14 is in its initial position. The switch 70 is currently "OFF" and no current is driving through the switch 70. FIG. 24 illustrates the switch 70 position when the cable link 14 is fully actuated. The switch 70 is now "ON" and is sending an electric current to a controller. FIG. 25 shows the switch 70 in comparison to the remaining components of the assembly when the cable link 14 is at full travel. FIG. 26 illustrates the activation point of the switch 70. When the cable link 14 is moving towards full travel, the switch 70 will turn "ON". During the return of the cable link 14 to its home position, the switch 70 will be deactivated at approximately mid-travel of the cable link 14. At this point in time, the controller will see that the switch 70 has turned "OFF" and will energize the motor 62, initiating an electric relock. By placing this point at mid-travel, the pawl 42 is no longer being held open by the cable link 14, meaning that it is able to hold the cam 40 in a "locked" state again. The release clutch 30 has also not fully been returned to a home position, so it has not become coupled between the cable link 14 and the pawl release link 12. Therefore, the system is able to electrically reset back to a "locked" state, without fully becoming "unlocked."

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A lock mechanism for a vehicle latch, the lock mechanism comprising:

a release cable actuated by a handle available to a user;

a cable end fitting disposed at an end of the release cable;

a cable link defining an opening for receiving the release cable, the cable link retaining the cable end fitting in the opening, wherein tensioning of the release cable translates the cable link from a first position to a second position by overcoming a spring force applied to the cable link, the spring force biasing the cable link to the first position;

a pawl release link selectively coupled to the cable link, the pawl release link and the cable link switchable between a coupled condition and a decoupled condition, the coupled condition resulting in corresponding translation of the cable link and the pawl release link, the decoupled condition resulting in independent translation of the cable link and the pawl release link when the release cable is actuated by the handle;

a release clutch pivotably coupled to the cable link and moveable between an unlocked position and a locked position, when in the unlocked position, the release clutch is disposed in contact with the pawl release link so as to couple the cable link and the pawl release link, corresponding to the coupled condition of the pawl release link and the cable link, and when in the locked position, the release clutch decouples the cable link and the pawl release link, corresponding to the decoupled condition of the pawl release link and the cable link; an electrically driven gear operative with the release clutch to electrically reset the release clutch to the locked position upon detection of a vehicle speed in excess of a threshold speed;

a cam rotatable about a cam axis between a first cam angular position and a second cam angular position, when in the first cam angular position, the cam biases the release clutch to the unlocked position, and when in the second cam angular position, the cam biases the release clutch to the locked position; and a pawl rotatable about a pawl axis between a first pawl angular position and a second pawl angular position, the pawl having a first contact surface and a second contact surface, the first contact surface is contacted by the cable link as the cable link moves from the first position to the second position so as to rotate the pawl, the second contact surface being engageable with a catch feature of the cam to retain the cam in the second cam angular position.

2. The lock mechanism of claim 1, wherein the pawl is spring biased in a first rotatable direction and the cam is spring biased in a second rotatable direction, the first and second rotatable directions opposite to each other.

3. The lock mechanism of claim 2, wherein the electrically driven gear is rotatable in the second rotatable direction about a gear axis.

4. The lock mechanism of claim 3, wherein the gear axis and the pawl axis are a common axis.

5. The lock mechanism of claim 3, wherein the electrically driven gear is driven by a worm of a worm gear arrangement, the worm being driven by an electric motor.

6. The lock mechanism of claim 3, wherein movement of the cable link from the second position to the first position allows rotation of the pawl to cause engagement of the first contact surface with the catch feature of the cam, the electrically driven gear rotates to bias the cam to position the catch feature and the first contact surface into engagement so as to reset the release clutch to the locked position.

7. The lock mechanism of claim 1, further comprising a switch located proximate to the release cable, the switch detecting movement of the cable link during movement between the first position and the second position of the cable link.

8. The lock mechanism of claim 7, wherein the switch is in a deactivated state when the cable link is in the first position, and is in an activated state when the cable link is in the second position.

9. The lock mechanism of claim 7, wherein the switch is located one-half of the distance between the first position and the second position.

10. The lock mechanism of claim 7, wherein the switch is in operative communication with a controller to indicate the position of the cable link, the controller is in operative communication with the electrically driven gear to actuate movement of the electrically driven gear to reset the release clutch to the locked position.

11. The lock mechanism of claim 7, wherein the threshold speed is 4 km/hr.

12. The lock mechanism of claim 1, wherein the threshold speed ranges from 3 km/hr to 5 km/hr.

13. A lock mechanism for a vehicle latch, the lock mechanism comprising:

a cable link;

a cable secured to the cable link and a handle;

a pawl release link, the cable link and the pawl release link switchable between an engaged condition and a disengaged condition, the engaged condition allows manual release of the vehicle latch, the disengaged condition prevents manual release of the vehicle latch, the pawl release link and the cable link slide linearly with each other and on a same plane when in the engaged condition and slid by actuation of the handle via the cable;

a release clutch pivotably mounted to the cable link and moveable between an unlocked position and a locked position, when in the unlocked position, the release clutch is disposed in contact with the pawl release link so as to provide the engaged condition, and when in the locked position, the release clutch decouples the cable link and the pawl release link so as to provide the disengaged condition; and an electrically driven gear operatively coupled to the release clutch, the electrically driven gear moves the release clutch to the locked position upon detection of a vehicle speed in excess of a threshold speed.

14. The lock mechanism as in claim 13, wherein the cable is secured to the cable link via a cable end fitting.

15. The lock mechanism of claim 13, wherein the threshold speed ranges from 3 km/hr to 5 km/hr.

16. The lock mechanism of claim 13, further comprising a cam rotatable about a cam axis between a first cam angular position and a second cam angular position, when in the first cam angular position, the cam biases the release clutch to the unlocked position, and when in the second cam angular position, the cam biases the release clutch to the locked position.

17. The lock mechanism of claim 16, further comprising a pawl rotatable about a pawl axis between a first pawl angular position and a second pawl angular position, the pawl having a first contact surface and a second contact surface, the first contact surface is contacted by the cable link as the cable link moves from a first position to a second position so as to rotate the pawl, the second contact surface being engageable with a catch feature of the cam to retain the cam in the second cam angular position.

* * * * *